United States Patent [19]

Bender

[11] 3,986,564

[45] Oct. 19, 1976

[54] WELL RIG

[76] Inventor: Emil A. Bender, 6625 Kane Way, Bakersfield, Calif. 93309

[22] Filed: Mar. 3, 1975

[21] Appl. No.: 554,452

[52] U.S. Cl. ..... 173/4; 173/151; 173/159; 254/93 R; 60/484

[51] Int. Cl.[2] ..... E21B 3/02; E21B 19/08

[58] Field of Search ..... 173/4, 8, 9, 151, 159; 254/93 R, 93 VA; 175/27, 122, 162, 195; 91/411 R; 60/484; 137/115, 116, 569

[56] References Cited

UNITED STATES PATENTS

| | | | |
|---|---|---|---|
| 1,790,913 | 2/1931 | Grau et al. | 254/93 R X |
| 2,320,874 | 6/1943 | Lehmann | 173/4 |
| 2,502,895 | 4/1950 | Shaffer | 254/93 R |
| 3,636,969 | 1/1972 | Jacobellis | 137/528 X |
| 3,792,836 | 2/1974 | Bender | 91/411 R X |

FOREIGN PATENTS OR APPLICATIONS

| | | | |
|---|---|---|---|
| 946,189 | 1/1964 | United Kingdom | 173/4 |

*Primary Examiner*—Ernest R. Purser
*Attorney, Agent, or Firm*—Strauch, Nolan, Neale, Nies & Kurz

[57] ABSTRACT

An improved, multipurpose oil well rig employing hydraulically actuable components. Two, three, or four or more piston cylinder fluid motors are provided in the rig lift system, powered either by a power unit having high pressure, low volume pumping characteristics for heavy loads and low pressure, high volume pumping characteristics for light loads or by a power unit incorporating a stored energy accumulator. Novel dump/check safety and control valve means are provided in either power unit. All conventional oil well rig mechanisms are eliminated. Specifically, there are no drawworks, drums, gears, chains, sprockets, clutches, travelling blocks, mechanical brakes, transmissions or line spoolers.

30 Claims, 16 Drawing Figures

FIG. 2
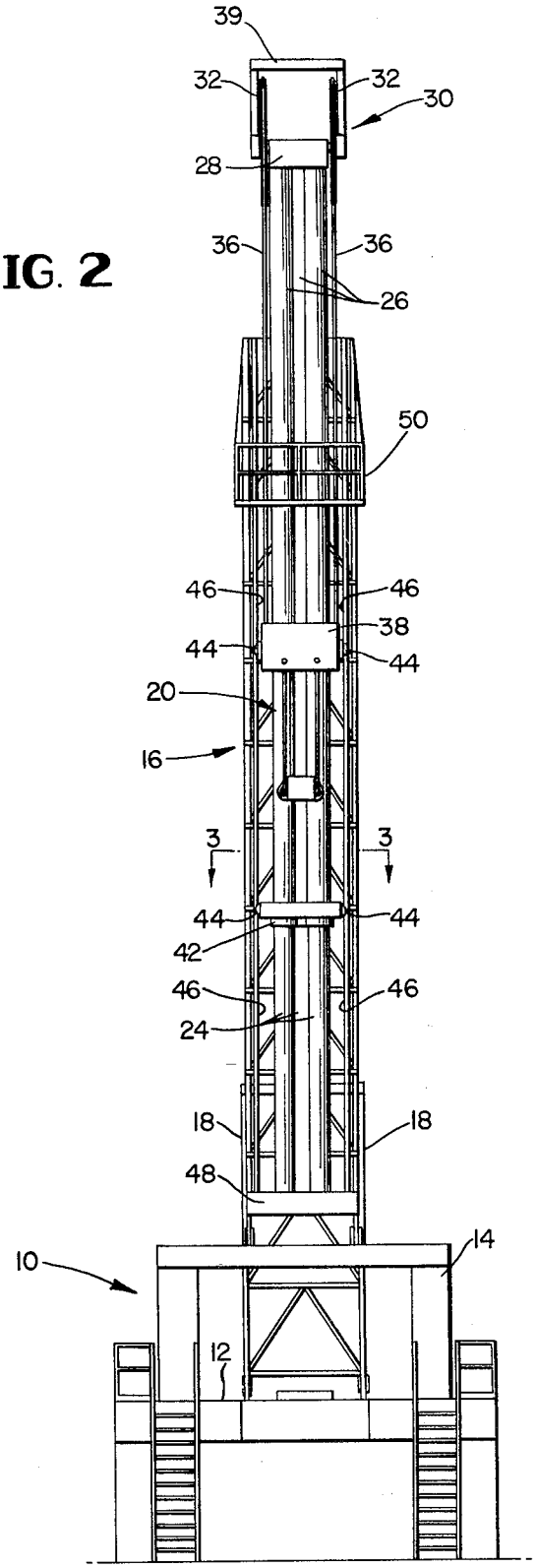
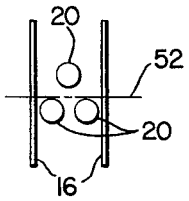
FIG. 3A
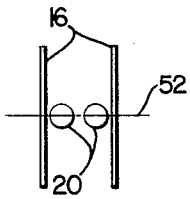
FIG. 3B
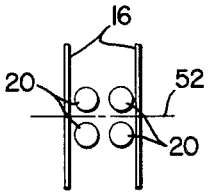
FIG. 3C

WELL RIG

BACKGROUND OF THE INVENTION

About 40 years ago, the first major technological conversion in oilwell drilling took place when the industry abandoned steam rigs and adopted power rigs. During the ten years preceeding 1935, when I drilled my last well with a steam powered rig, I could see that steam rotary rigs were becoming obsolete. Anywhere from ten days to three weeks of preparation were required to start drilling with a medium sized rig, capable of drilling in the range of 5000 feet to 8000 feet. Installation required setting up a wooden or steel derrick, three to five boilers, fuel tanks, a water treatment system, and steam pressure pipe lines all contributing to a very inefficient source of power.

The changeover to power rigs resulted in a more efficient, simplified system. Usually all that was required was to arrange engine compounds, chain or gear transmissions, fluid couplings torque converters and air operated friction clutches. Increased portability of rigs was a significant development, particularly in shortening set up time, as evidenced by twenty or more of my own patents issued over the last thirty or more years. Specifically, with some of my rigs it is possible to move, set up and spud a well in as short a time as 8 hours.

Although set up times have been considerably shortened, the mechanical disadvantages of power rigs remain. An average rig has miles of line, up to eight or ten friction clutches, hundreds of bearings and enclosed chain gear cases and elaborate hydromatic or electromagnetic braking systems, as well as drawworks, sprockets, drums, line spoolers and travelling blocks. Little has been done to improve drilling rigs since the late 1950's, since few rigs have been manufactured and sold. Manufacturers' attention has been devoted to offshore drilling and most manufacturers have order backlogs of up to ten years to fulfill.

In the past 10 to 15 years, hydraulic systems have virtually totally replaced mechanical components in equipment such as fork lifts, cranes, bulldozers, graders, skip loaders and similar items. Little has been done in the oilwell drilling industry where progress has been very slow.

One early example of a hydraulic drilling rig was on display at the Tulsa International Oil Show, Tulsa, Oklahoma, in 1948. Unfortunately the design was poor and the unit finally wound up at a scrap yard in Long Beach, California.

Resistance of the industry to apply hydraulics to oil well drillings is well evidenced by the paucity of available patent literature on the subject, other than my own patents and a few others disclosing hydraulics used in oil well pumps. U.S. Pat. No. 2,807,441 issued to B. W. Sewell on Sept. 24, 1975, discloses a very small, portable hydraulic drilling rig with a single cylinder 14 while U.S. Pat. No. 2,438,277 issued to R. E. Fife et al on Mar. 23, 1948 shows hydraulics used with the mast of a service rig. A hydraulically actuated cat line is disclosed in U.S. Pat. No. 2,324,096 issued to R. M. Lilley on July 13, 1943. Basic hydraulics for a remote environment lift are illustrated in U.S. Pat. No. 2,897,907 issued to A. E. Blount on Aug. 4, 1959.

More significant and basic developments in the application of hydraulics to oilwell drilling servicing and/or pumping are found in my own prior U.S. Pat. Nos. 3,345,950, issued Oct. 10, 1967; 3,538,777, issued Nov. 10, 1970; 3,777,491 issued Dec. 11, 1973; and 3,792,836, issued Feb. 19, 1974.

This last mentioned patent discloses my first major development of a completely hydraulic well rig but does not disclose major improvements as disclosed herein, including a more sophisticated and reliable power source and an improved safety dump valve assembly. The fluid pressure operated differential piston safety dump valve as disclosed herein eliminates the need for sophisticated internal construction of the piston cylinder fluid motors, such as disclosed in my prior U.S. Pat. No. 3,792,836, and is far more reliable than the simple check valve 77 disclosed in U.S. Pat. No. 2,897,907 discussed above. Other remote environment differential piston valves are disclosed in prior U.S. Pat. Nos. 1,112,109 issued Sept. 29, 1914 to J. Billingham et al; 3,244,396 issued Apr. 5, 1966 to A. L. Miller; 3,519,022 issued July 7, 1970 to K. Chung et al; 3,542,332 issued Nov. 24, 1970 to A. A. Chevalier et al; and 3,734,455, issued May 22, 1973 to P. J. Natho et al.

SUMMARY OF THE INVENTION

It is a principal object of this invention to provide a well drilling rig incorporating a hydraulic lift assembly capable of lifting light loads at high speed and very heavy loads at lower speeds as a replacement for the conventional drawworks assembly.

It is an object of this invention to provide a well drilling rig having a hydraulic lift assembly with two, three or four or more piston cylinder fluid motors dependent upon predetermined maximum hook loads.

It is another object of the present invention to provide a multipurpose oil well rig having a hydraulic lift assembly in place of the conventional drawworks assembly, fluid under pressure for the lift being provided by independent sources, both for high pressure, low volume fluid for heavy loads and for low pressure, high volume fluid for light loads.

It is yet another object of the instant invention to provide a multipurpose oil well rig incorporating a hydraulic lift in place of the conventional drawworks and having a fail safe mechanism comprising a novel dump/check safety and control valve structure.

It is still another object of this invention to provide a multipurpose oil well rig having a hydraulic lift which eliminates conventional rig components such as drawworks, drums, gears, chains, sprockets, clutches, travelling blocks, mechanical brakes, transmissions and line spoolers.

It is a further object of the invention to provide a multipurpose oil well rig having a hydraulic lift and employing screw pumps and motors.

It is a still further object of the invention to provide a multipurpose oil well rig incorporating a hydraulic lift, and powered from a fluid pressure source including a prime mover and an accumulator.

Yet another object of the present invention is to provide a multipurpose oil well having a hydraulic lift assembly and a most structure and support whereby lift loads are borne entirely by the support for the mast, the mast including guide rails for guiding movement of the lift structure.

Further novel features and other objects of this invention will become apparent from the following detailed description, discussion and the appended claims taken in conjunction with the accompanying drawings.

BRIEF DESCRIPTION OF THE DRAWINGS

Preferred structural embodiments of this invention are disclosed in the accompanying drawings in which:

FIG. 2 is a front elevation view of the drilling rig as shown in FIG. 1;

FIGS. 3A, 3B and 3C are partial sectional views taken along lines 3—3 of FIG. 2, illustrating the hydraulic lift of the invention using 3, 2 and 4 piston-cylinder fluid motors, respectively;

DESCRIPTION OF THE PREFERRED EMBODIMENTS

Figure 1:
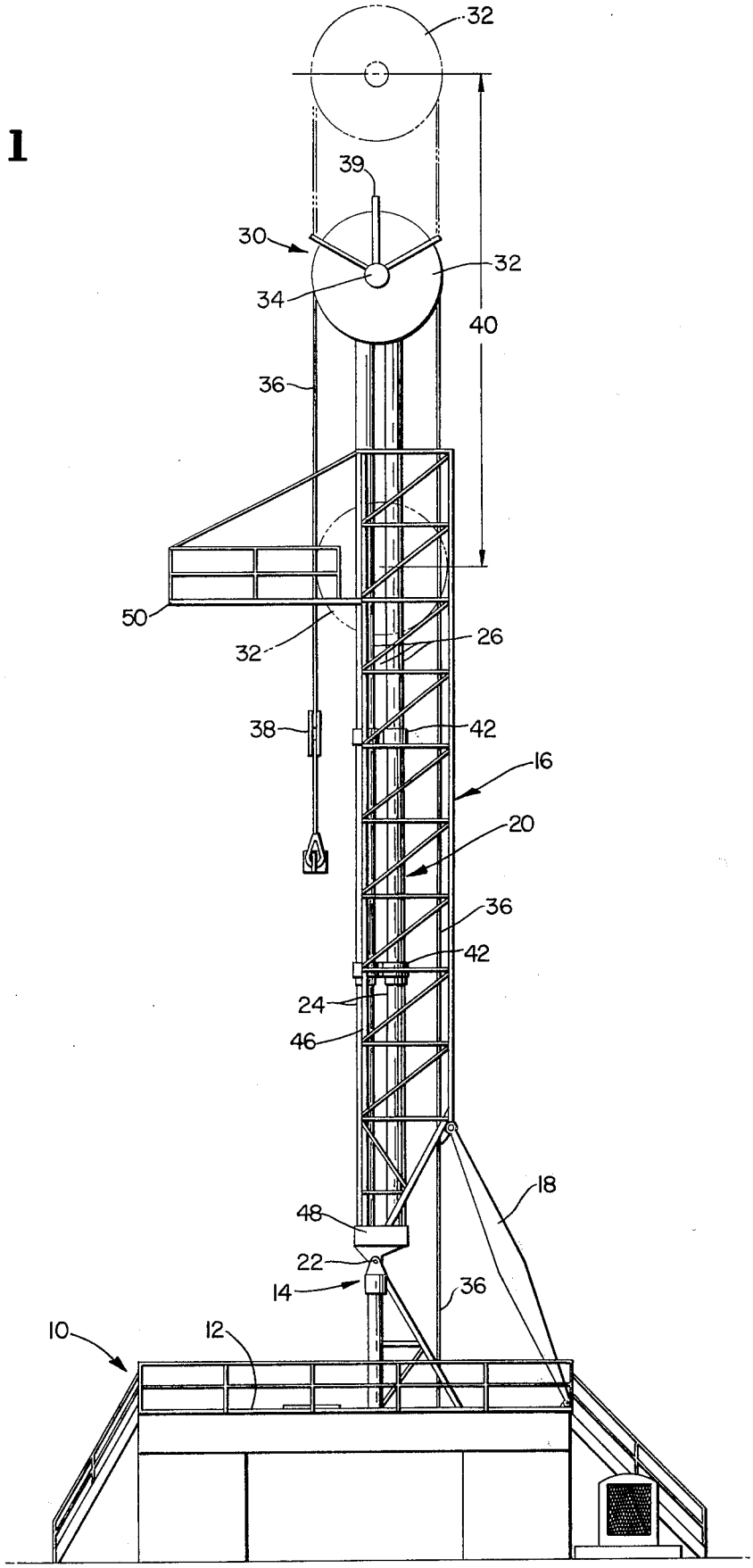
FIG. 1 is a side elevation view of a preferred embodiment of the invention, a drilling rig.

FIGS. 1 and 2 illustrate a preferred embodiment of the invention, a drilling rig. A derrick platform 10 is positioned over the point where a well is to be drilled and includes a floor 12 upon which is located a pivot mount structure 14 for a single, pivoting mast 16. A lever lift system 18 (not shown in detail) raises mast 16 from a horizontal transport mode (not shown) to an upright, vertical working mode, as depicted in FIGS. 1 and 2. In this exemplary embodiment, three piston cylinder fluid motors 20 are provided, and arranged side by side within mast 16, with the effective thrust axis vertically aligned with the hinge point 22 of mount 14.

Each piston cylinder fluid motor 20 includes a stationary piston rod 24, an internal piston (not shown) and an externally upwardly extending reciprocating cylinder or ram 26 having its upper, closed end secured to a cross member 28 which forms the base of a sheave assembly 30. A pair of oversized sheaves 32 are mounted on the ends of an axle 34 on member 28. About each sheave is trained a cable 36 having its deadline end secured to derrick floor 12 and its free end attached to a conventional yoke 38 which forms the lift end of the drilling rig. Cable retainers 39 may be provided over each sheave 32 to assure retention of each cable in its sheave. The result is a simple two to one ratio lift or hoist, movement of sheave assembly through a given distance imparting vertical movement to yoke 38 through twice that given distance. By way of specific example, the extreme limits of travel of sheave assembly 30 are shown at 40 (FIG. 1); this distance is 36 feet. Thus, the elevator travel for yoke 38 is 72 feet. Standard drill pipes and well tubing sections have lengths generally of 30 feet. Thus, doubles (i.e., 60 feet) of drill pipes or tubings may be handled without need of double stroking; this imparts a significant cost and time savings advantage to the present invention.

As shown in FIGS. 1 and 2, cylinders or rams 26 are bracketed together by travelling braces 42, each having a pair of guide wheels 44 riding along facing vertical rails 46 of mast 16. The lower ends of stationary piston rods 24 are firmly supported and centered on base 48 of pivot mount 14 so that all lift loads are carried by mount 14, rather than by mast or derrick 16. Of course, in conventional rigs, the derrick bears the lift load. Here, mast 16 serves only as a guide for rams 26 and carries no loads, save for the conventional racking platform 50. Therefore, mast 16 may be of relatively lightweight construction and needs to have only a length or height to accommodate the upper limit of travel of the uppermost travelling brace 42. This not only results in a much less expensive derrick but also provides one that is far easier to set up for drilling. Also, mast 16 will be less than 60 feet long, thus providing a load which is within legal length limits for transportation over highways. (Compare for example, the derrick 16 disclosed in my prior U.S. Pat. No. 3,792,836).

FIGS. 3A, 3B and 3C illustrate alternative rigs provided with 3, 2 or 4 piston cylinder fluid motors 20, respectively, depending on the lift load requirements for the particular rig as set forth in greater detail below. The centralized location of motors 20 over hinge point 22 and the coincident axis of axle 34 for sheaves 32 is shown by centerline 52 in FIGS. 3A, 3B and 3C. This arrangement assures that lift loads will be borne by pivot mount 14 and not by mast 16.

Figure 4:
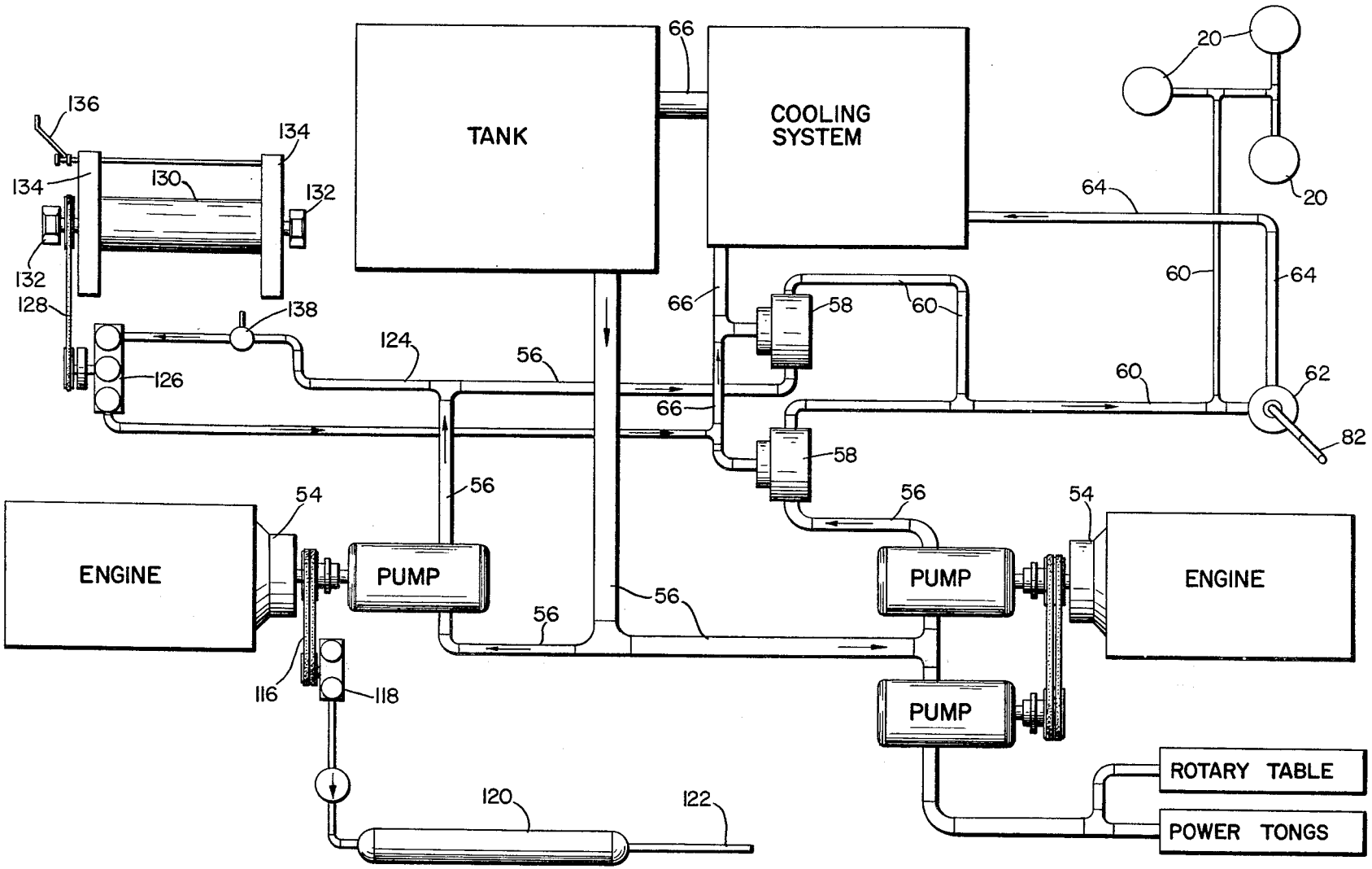
FIG. 4 is a diagrammatic top view of an embodiment of the hydraulic fluid pressure system of the invention.
Figure 5:
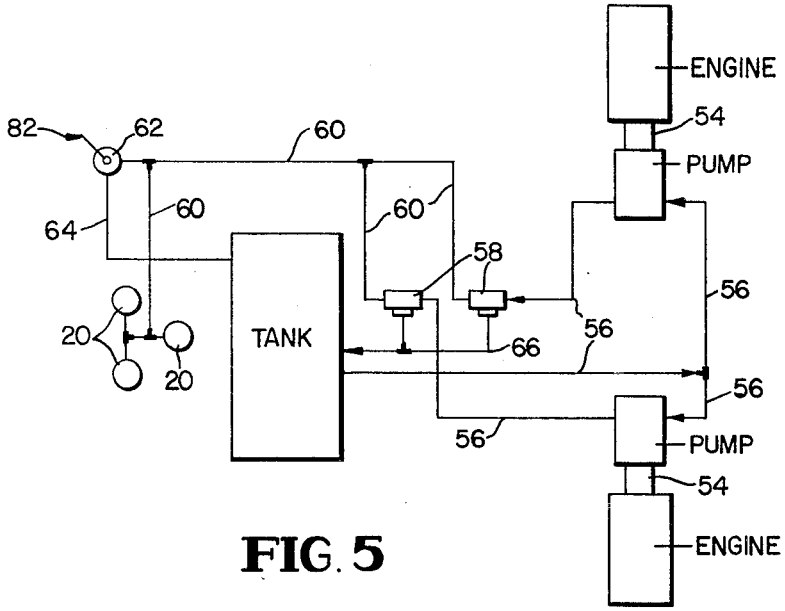
FIG. 5 is a schematic view of the primary components of the embodiment of the hydraulic fluid pressure system shown in FIG. 4.
Figure 6:
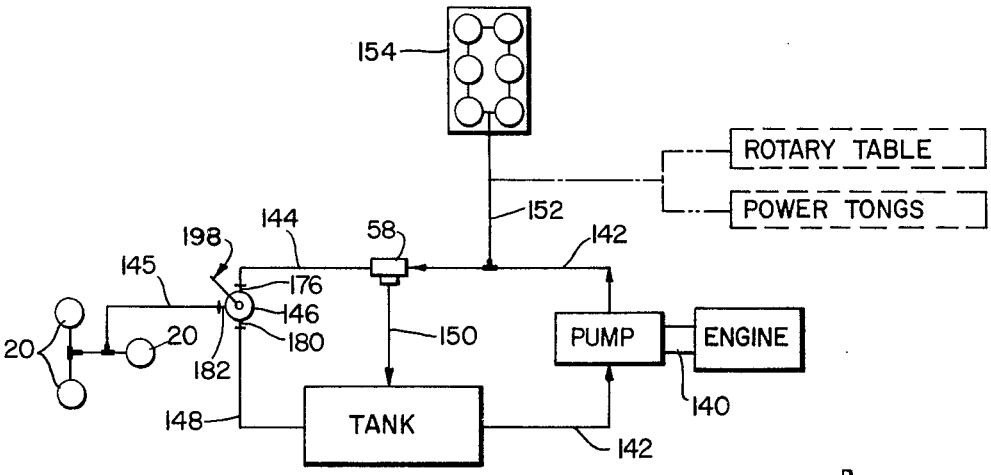
FIG. 6 is a schematic view similar to FIG. 5 but showing an embodiment of the invention employing an accumulator system.

Turning now to FIGS. 4–6, various embodiments of the hydraulic fluid pressure lift system of the present invention will be discussed in detail. Schematic diagrams of two basic embodiments are disclosed in FIGS. 5 and 6.

In FIG. 5, the prime mover comprises a pair of power plants, which may be conventional diesel engines. A hydraulic pump is driven from each engine through a torque converter 54 which of course, reduces fluid volume from the pump as pressure within the hydraulic system increases. A supply of hydraulic fluid is provided from a supply tank, via primary conduiting 56 through the pumps to a pair of 3-port safety/dump and control valves 58, which are disclosed in detail below. Via secondary conduiting 60, hydraulic fluid under pressure is directed through a 2 port control or braking valve 62 to piston cylinder fluid motors 20. The closed hydraulic circuit is completed by first relief conduiting 64 from control valve 62 back to the supply tank and by second relief conduiting 66 from safety/dump valves 58 to the supply tank.

The components of this sytem will now be discussed in greater detail. The engines are standard internal combustion engines (e.g., diesel, gasoline, etc.), or electric motors. 200 SSU system hydraulic fluid is suitable under average conditions while a more viscous fluid will be used in a cold environment. Non-foaming additives may be provided in the fluid. Any type of hydraulic pump is suitable. However, in one embodiment the hydraulic pumps employed are of the constant displacement rotary screw type due to their non-pulsating features. An excellent pump for the purposes of this invention is the "IMO" pump, marketed by De Laval Turbine, Inc. of Trenton, New Jersey. This pump provides constant displacement axial flow of fluid and is highly reliable over a long period of use, in that it includes only 3 moving parts, none of which are reciprocating.

Of even greater significance in this embodiment of the invention is the provision of two such pumps of similar construction which together provide high speed, low load capacity and low speed high load capacity in the hoist. In a primary embodiment of the invention, two De Laval pumps each having a rated maximum capacity of 750 gallons per minute (gpm) at 1750 psi are used. Three piston cylinder fluid motors 20 (FIG. 5) each having an internal diameter of 12.5 in. and thus a surface working area of 122 in.$^2$ are provided. The system thus employs large diameter piston cylinder fluid motors 20 so that maximum working pressure within the hydraulic system is kept at a reasonably low and, more importantly safe level of 1500 psi. At this level, simple arithmetic reveals that the maximum lift force that may be imparted to the three piston cylinder fluid motors 20 together is about 549,000 pounds. Since the lift is a 2 to 1 ratio lift, maximum hook load is one-half this figure, or about 274,500 lbs., which is more than sufficient for most drilling operations. In a smaller rig employing 2 piston cylinder fluid motors 20 of the same dimension (FIG. 3B) maximum hook load would be 183,000 lbs. and in the larger rig illustrated in FIG. 3C where 4 piston cylinder fluid motors 20 of the same dimensions are used, maximum hook load becomes 366,000 lbs.

Returning to the primary embodiment of the invention (FIG. 3A) and calculating volume (in gallons) required to raise the lift its full travel limit of 36 feet, thus resulting in elevator travel of 72 feet, 684 gallons of fluid are required. Since the two pumps are constant displacement pumps of 750 gpm each, it is seen that it takes about 210 seconds or 3.5 minutes to move yoke 38 through a distance of 72 feet under a full load of 274,500 lbs, the volume of fluid being decreased to about 200 gmp. This is the equivalent to the performance of existing mechanical drawworks. Under a light load condition as, for example empty elevator travel when the system may be operating at from 50 to 300 psi, the time required to move yoke 38 through a distance of 72 feet will be reduced to about 28 seconds or 0.5 minutes the volume of fluid being pumped increasing to about 750 gpm for each pump.

The lift/time capacities provided by the present invention fully meet the requirements of the drilling art for high hook capacity, high speed drilling operations.

Figure 9:
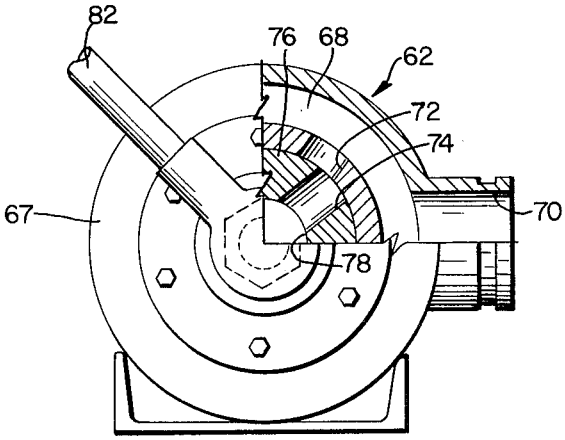
FIGS. 9 and 10 are a quarter sectioned side elevation view and an end view, respectively, of the balanced rotary control/brake valve of the invention used in the hydraulic system shown in FIG. 5.
Figure 10:
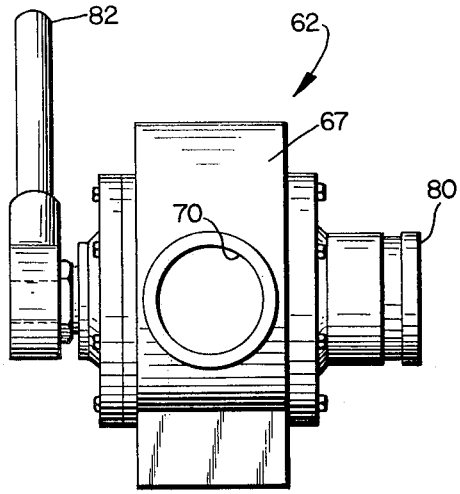

The control or braking valve 62 is a four port, balanced rotary valve of the type disclosed in my aforementioned U.S. Pat. No 3,792,836 (FIGS. 11–15 and Column 8, lines 19–45) and illustrated herein by FIGS. 9 and 10. Control valve 62 includes a casing 67 with an outer, annular chamber 68 having an inlet 70 communicated to secondary conduiting 62 (FIG. 5) and four (4) circumferentially equispaced radial ports 72 arranged internally to communicate with four (4) similarly spaced, matching radial ports 74 in an internal rotary plug 76. The internal cavity of the plug 76 constitutes a central outlet chamber 78 coextensive with an outlet 80 from valve casing 67 communicated to the supply tank via relief conduit 64 (FIG. 5) A control handle 82 is secured to a stem of plug 76 opposite the outlet 80 (FIG. 10). The valve is balanced because of the provision of four equispaced ports about an axial flow center outlet and may be set to any one of an infinite number of flow positions between fully open and fully closed, one such intermediate position being illustrated in FIG. 9. Referring now to FIG. 5, when valve 62 is closed, fluid is directed to piston-cylinder motors 20 and the lift ascends (FIG. 1). When valve 62 is fully open, fluid passes therethrough to the supply tank and the weight of the lift causes it to descend. Braking action in ascent or descent is provided by intermediate positions of the valve determined by the rig operator.

Figure 8:
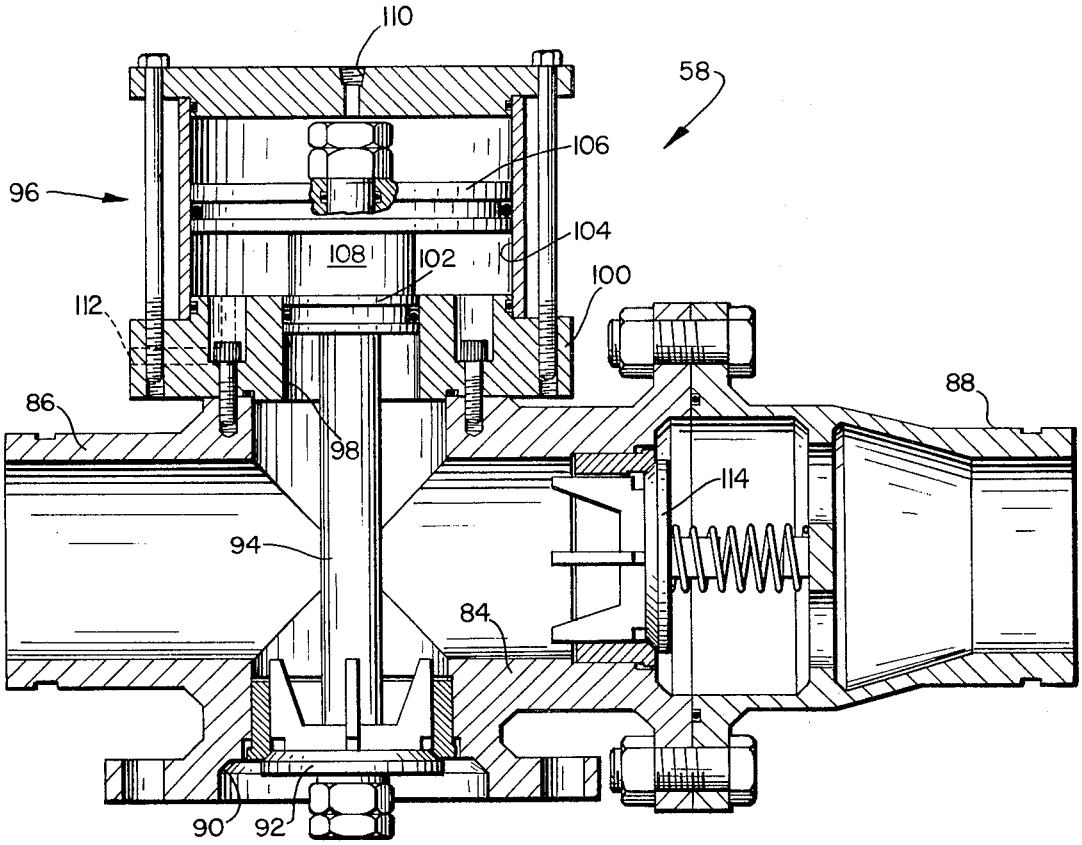
FIG. 8 is a section view of the balanced dump/check safety and control valve of the invention.

Internal detail of the dump and control valves 58 are illustrated in FIG. 8. A valve body 84 includes inlet port 86, connected to primary conduiting 56 (FIG. 5), an outlet port 88, connected to secondary conduiting 60, and a dumping port 90, connected to the supply tank via relief conduiting 66. Port 90 is normally closed by a poppet valve 92 guided and seated therein. Valve 92 has a valve stem 94 extending through the valve body 84 and connected to a fluid pressure operated control or pilot valve assembly 96, mounted on valve body 84 on a side opposite that of dumping port 90. Control assembly 96 has a cylindrical opening 98 formed in its base 100, enabling the valve stem 94 to connect to the control assembly piston through a secondary piston and seal unit 102 which is disposed in the opening 98. The control assembly includes a cylindrical chamber 104 on the base enclosing an internal control piston 106 connected to sealing piston 102 by piston rod 108. An entry port 110 is formed in the top of chamber 104 for admission to the upper working part of chamber 104 of control fluid under pressure to the upper face of piston 106, preferably compressed air from a suitable compressor. An entry port 112 is formed in base 100 for admission to the lower working part of chamber 104 of control fluid under pressure to the lower face of piston 106, preferably compressed air from a suitable compressor (not shown). A downstream check valve 114 is located in valve body 58 to prevent backflow of fluid through dump valve 58. Adjoining surfaces are sealed by conventional O-rings, as illustrated.

The principal function of this valve is to serve as a clutch for all idling and operating modes. Air under pressure is admitted to the upper part of chamber 104 to depress piston 106, open valve 92 and circulate fluid directly back to the reservoir during idling conditions. During the operating mode, air under pressure is admitted beneath piston 106 and released from above piston 106. The valve 58 now serves as a dump and safety check valve in the following manner.

The internal areas of piston 106 and dumping valve 92 subjected to fluid under pressure are unequal, the working face area of control piston 106 being significantly greater than that of dumping valve 92. Accordingly, far less pressure beneath piston 106 is required to maintain dumping valve 92 closed, with respect to line pressure in the hydraulic fluid system. In the preferred embodiment, the working face area ratio of piston 106 with respect to dumping valve 92 is about 14 to 1. Thus, at maximum design pressure in the hydraulic system of about 1500 psi, air pressure in chamber 104 is set at 108 psi to maintain dumping valve 92 closed. Obviously, when hydraulic line pressure exceeds 1500 psi within valve body 84, dumping valve 92 opens to relieve excess fluid over predetermined pressure back to the supply tank. When lighter hook loads are to be lifted, air pressure within chamber 104 will be set lower. For example, with a hook load of 220,000 lbs., dump and control valve 58 will be set to relieve at 1200 psi, according to the discussion above regarding the pumps and piston cylinder fluid motors. At this setting, air pressure within chamber 104 is reduced to 86 psi. For very light loads, with the pressure of hydraulic line fluid not to exceed 500 psi, chamber 104 is set at 36 psi, and with almost no load at all (e.g., empty elevator travel while going into the well to pick up a pipe string), chamber 104 is set at 22 psi so that hydraulic line pressure does not exceed 300 psi. Thus each dump valve 58 serves as a complete safety mechanism, capable of functioning over the entire range of operating conditions in the hoist, no load to maximum load. Additionally, it can be seen that only two controls are necessary to operate the working load, one for the control valve 62 and one for the dump and control valve 58, to regulate the air pressure within chamber 104. Two conventional air switches (not shown) on the rig operator's panel (not shown) may be provided for this purpose.

An expanded disclosure of a hydraulic system suitable for use in the invention and including the basic components illustrated in FIG. 6 is found in FIG. 4. A second pump may be driven from one of the prime movers as shown at the lower right hand corner of FIG. 6 to provide hydraulic fluid under pressure for a conventional hydraulic rotary table and/or conventional hydraulic power tongs. The rotary table may be controlled by a metering valve similar to control valve 62 (not shown). Additionally, one of the prime movers may be used to drive a catline winch (not shown) by means of drive belts 116 connected to a small air compressor or hydraulic pump 118 which provides fluid pressure for an accumulator tank 120. Outlet line 122 communicates fluid under pressure to the motor of the suitable catline winch (not shown).

For well servicing operations, a standard sand line is used to bail sand out of a well. The line is free wheeled to the well bottom, which may be several thousand feet down, and then quickly raised to clean the well and well bore. For this purpose, a hydraulic branch line 124 may be interposed in primary conduiting 56 for providing fluid under pressure to a hydraulic motor 126. A chain drive 128 connects motor 126 with reel 130, and the remaining conventional components of the sand reel system include clutches 132, brakes 134 and brake lever 136. Hydraulic fluid control valve 138 regulates the operation of motor 126 which may be a rotary motor such as a smaller version of the De Laval IMO pump discussed above.

A cooling system may be provided as illustrated to cool the hydraulic fluid before it returns to the supply tank. In drilling rigs, a large supply tank of water (not shown) is provided; the fluid may be conduited through such water supply for cooling purposes. On service rigs where no such water supply is at hand, a radiator may be provided to cool the hydraulic fluid.

Figure 7A:
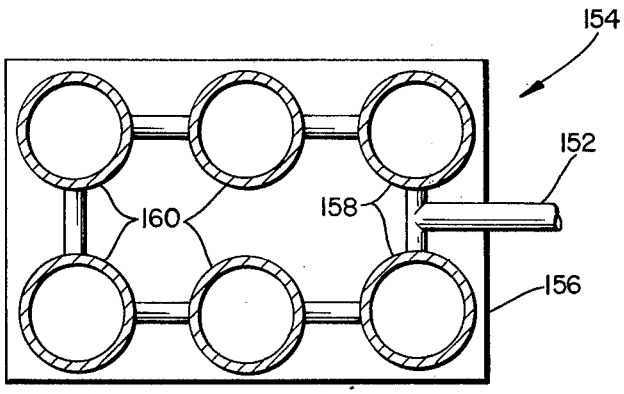
FIGS. 7A and 7B are section and elevation views respectively of accumulators that may be used in the hydraulic system depicted in FIG. 6.

Turning now to FIGS. 6 and 7A a second embodiment of the hydraulic system of the invention will be discussed, wherein an accumulator system is employed with a single engine and pump. The principal advantage of the accumulator system is that a smaller engine and pump may be used for continuously providing the accumulator with hydraulic fluid under pressure, in that energy stored in the accumulator is drained only for short time durations in operating a drilling rig. Additionally, a torque converter is not necessary between engine and pump, although one may be provided as illustrated at 140. Primary conduiting 142 interconnects the supply tank through the pump with a single dump valve 58. Secondary conduiting 144 and 145 conveys hydraulic fluid under pressure from dump valve 58 through a three-port spool valve 146, which will be discussed in detail below, to piston cylinder fluid motors 20. First relief conduiting 148 drains fluid from spool valve 146 back to the supply tank and second relief conduiting 150 conveys overpressure fluid from dump valve 58 to the supply tank.

Figure 7B:
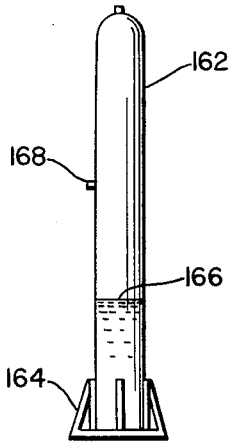

A branch line 152 conveys fluid under pressure from the pump to an accumulator system 154. In a preferred embodiment, accumulator system 154 comprises six vertically disposed tanks, each about 40 feet tall with an outside diameter of about 20 inches mounted in a rack 156, 2 tanks 158 being filled with hydraulic fluid under pressure and four tanks 160 being filled with an inert gas such as nitrogen, conveyed from a suitable source (not shown). As in the embodiment shown in FIG. 4, a hydraulic rotary table and/or hydraulic power tongs may be driven from accumulator system 154, as well as a catline hoist and/or a sand reel (not shown). An alternative accumulator system is shown in FIG. 7B, including a single, large (48 in. diameter or more) tank 162 mounted in a stand 164, partially filled with hydraulic fluid, the maximum amount being indicated at 166, and partially filled with an inert gas such as nitrogen provided from a suitable source (not shown) through a fitting 168.

Returning again to FIG. 6, details of the remaining components of this system are as follows. The prime mover is a diesel engine, preferably of about 500 hp and the pump is a triplex or triple piston, single acting hydraulic pump requiring an input of about 500 hp. A very suitable pump is the Type PY-7 manufactured by Gardner-Denver of Quincy, Illinois. This particular pump will deliver about 480 gpm at 1500 psi which, in this accumulator system, more than meets the requirements of the invention. For heavier load requirements, a Gardner-Denver Type PO-7 or PV-9 six cylinder pump may be used.

Figure 11:
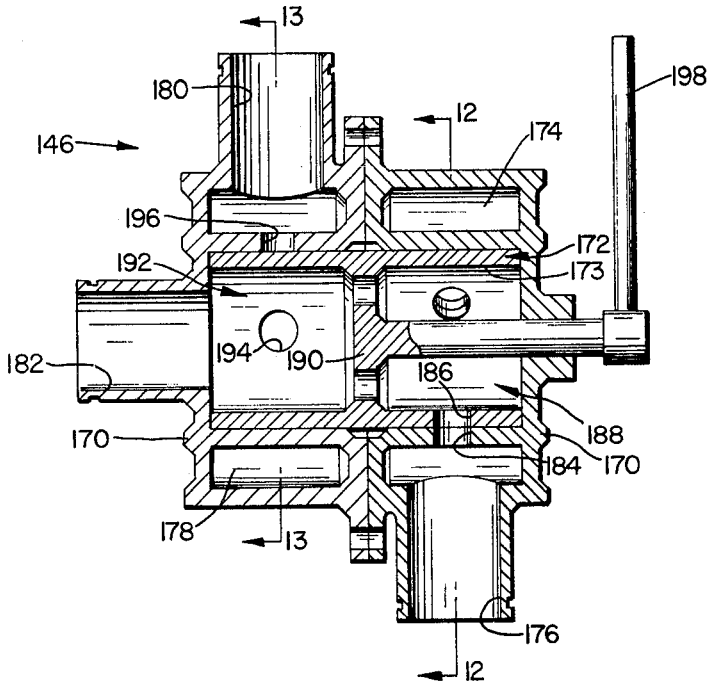
FIG. 11 is a section view of the closed center three-way rotating spool valve of the invention used in the hydraulic system shown in FIG. 6.
Figure 12:
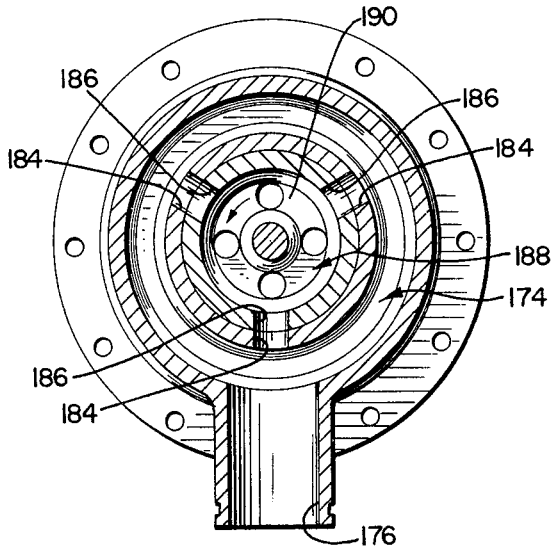
FIGS. 12 and 13 are section views taken along lines 12—12 and 13—13, respectively, of FIG. 11.
Figure 13:
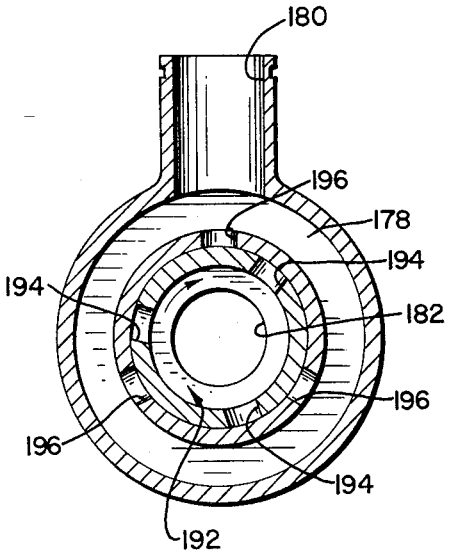

Spool valve 146 is disclosed in detail in FIGS. 11, 12 and 13. Valve 146 is an axial flow three port rotary spool valve having an outer body member 170 and an inner, hollow, rotatable spool member 172. Body 170 has an annular inlet chamber 174 connected to secondary conduiting 144 (FIG. 6) and accumulator 154 via an inlet 176 and an adjacent annular outlet chamber 178 connected via outlet 180 to relief conduit 148 and the supply tank. Chambers 174 and 178 may be formed as separate members as illustrated. An axial outlet 182 on valve body 170 communicates with the interior of the outlet side of spool 172 and is connected via conduit 145 to piston cylinder fluid motors 20.

To more specifically describe the spool valve 146, three circumferentially equispaced ports 184 are formed through the inner annular wall of inlet chamber 172 and are alignable with three (3) similarly spaced inlet ports 186 formed through the inlet or right-hand cylindrical wall 173 of spool member 172 and communicating with a first inlet chamber 188 formed therein. Fluid passes through an intermediate support wall or baffle 190 in spool 172 to a downstream open ended outlet (left-hand) chamber 192 having three (3) circumferentially spaced outlet ports 194 alignable with three (3) similarly spaced outlet ports 196 formed through the interior wall of the valve body outlet chamber 178. As shown in FIGS. 12 and 13, the respective sets of inlet ports 184, 186 and outlet ports 194, 196 are circumferentially offset so that, when sets 184, 186 are fully aligned (FIG. 12) fluid can flow into inlet 176 to inlet chamber 174 and through ports 184, 186 to the spool inlet chamber 188, thence through baffle 190 and spool outlet chamber 192 only through axial outlet 182, conduit 145 and piston cylinder fluid motors 20. The second set of ports 194, 196 being out of alignment (FIG. 13) prevents fluid from by-passing to the supply tank.

As can be seen in FIGS. 12 and 13, the valve body inlet chamber ports 184 and outlet chamber ports 196 are circumferentially offset 60° from each other while the sets of spool inlet ports 186 and spool outlet ports 194 are circumferentially offset 20° from each other. Thus a 40° rotation of spool 172 counterclockwise, in the sense of FIG. 13, by control handle 198 will bring ports 196 and 194 into registry so that fluid will drain from piston cylinder motors 20 to outlet chamber 178, outlet 180 and the supply tank and the lift will descend of its own weight. Simultaneously, ports 184 and 186 will be out of registry so that fluid flow from accumulator 154 is blocked. Additionally, any one of a number of intermediate positions between the two extremes just discussed provides carefully controlled ascent and descent of the lift.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed and desired to be secured by Letters Patent is:

1. A well drilling and servicing rig comprising a closed circuit hydraulic fluid pressure lift system and lift line means directly operable therefrom, said closed circuit hydraulic fluid pressure lift system including prime mover means with hydraulic fluid pump means for providing hydraulic fluid under pressure, at least a pair of reciprocable piston cylinder fluid motors, fluid pressure controlled dump valve means, control valve means, a hydraulic fluid supply tank and conduit means interconnecting the components of said fluid pressure lift system, said conduit means comprising primary conduiting connecting said supply tank through said pump means and said dump valve means, secondary conduiting connecting said dump valve means through said control valve means to said piston cylinder fluid motors, first relief conduiting connecting said control valve means to said supply tank and second relief conduiting connecting said dump valve means to said supply tank, said dump valve means including fluid pressure regulated valve means for relieving hydraulic fluid in said system through said second relief conduiting to said supply tank in response to pressure in said system exceeding a predetermined pressure and check valve means preventing backflow of fluid through said dump valve means, each of said reciprocable piston cylinder fluid motors including a stationary component and a reciprocating component, and means connecting said lift line means to said reciprocating components.

2. The well rig as recited in claim 1 wherein said closed circuit hydraulic fluid pressure lift system comprises three reciprocable piston cylinder fluid motors.

3. The well rig as recited in claim 1 wherein said closed circuit hydraulic fluid pressure lift system comprises four piston cylinder fluid motors.

4. The well rig as recited in claim 1 further comprising a platform, a vertically disposed single mast derrick mounted on said platform, said pair of piston cylinder fluid motors being mounted side by side with their axes vertical and parallel within said derrick, each cylinder thereof comprising said reciprocating component, a sheave assembly mounted on the upper free ends of the cylinders of said fluid piston cylinder motors, and a pair of sheaves on said sheave assembly, over which said lift line means are trained.

5. The well rig as recited in claim 4 wherein said lift line means comprise a pair of cables, each cable having one end secured to said platform and a free end trained over one of said sheaves, and a yoke interconnecting said cable free ends, thereby forming a 2 to 1 ratio lift whereupon movement of said sheave assembly through a predetermined vertical distance imparts movement of said yoke through twice said predetermined vertical distance.

6. The well rig as recited in claim 4 wherein said derrick includes base means for pivotally mounting said derrick on said platform, said base means further comprising support means for centrally locating the effective axial thrust line of said piston cylinder fluid motors over said pivotally mounting means, whereby lift loads are carried by said pivotally mounting means.

7. The well rig as recited in claim 6 wherein said means pivotally mounting said derrick on said platform further comprise lever lift means for moving said derrick and fluid pressure piston cylinder motors from a horizontal, transport mode to an upright, vertical operable mode.

8. The well rig as recited in claim 6 wherein said derrick further comprises vertically disposed, guide rail means and travelling brace means for bracketing said movable cylinders together, said brace means including guide means engaged on said rail means for guiding reciprocating vertical travel of said movable cylinders and sheaves.

9. The well rig as recited in claim 4 wherein the structure of said derrick terminates at a point well below the upper limit of travel of said sheave assembly, said sheave assembly, sheaves and pair of cables being unattached to said derrick.

10. The well rig as recited in claim 1 wherein said prime mover means comprise a single prime mover and said pump means comprise a single pump, said closed circuit hydraulic fluid pressure lift system further comprising accumulator means interposed in said primary conduiting downstream of said single pump for storing hydraulic fluid under pressure being supplied by said pump.

11. The well rig as recited in claim 10 wherein said accumulator means comprise a single, closed accumulator tank, partially filled with said hydraulic fluid under pressure and loaded with a supply of inert gas under pressure.

12. The well rig as recited in claim 10 wherein said accumulator means comprise a plurality of accumulator tanks, a portion of said accumulator tanks being filled with hydraulic fluid under pressure, the remainder of said accumulator tanks being loaded with a supply of inert gas under pressure.

13. The well rig as recited in claim 10 further comprising rotary table means driven from said accumulator means.

14. The well rig as recited in claim 10 further comprising rotary table means and power tong means driven from said accumulator means.

15. The well rig as recited in claim 10 wherein said control valve means comprises a three port balanced rotary spool valve comprising means defining a first and a second annular outer axially aligned fluid chambers, said first chamber having a plurality of circumferentially spaced inlet ports on the inner face of said first chamber, said second chamber having a plurality of circumferentially spaced outlet ports on the inner face of said second chamber, circumferentially offset with respect to said first chamber inlet ports, said first chamber including inlet means connected through said secondary conduiting to said dump valve means, said second chamber including outlet means connected through said second relief conduiting to said supply tank, a hollow spool member coaxially disposed within said annular outer axially aligned fluid chambers, a set of spool inlet ports alignable with said spaced inlet ports and a set of spool outlet ports alignable with said spaced outlet ports, said sets of spool inlet and spool outlet ports being arranged so that, when said spool inlet and first chamber inlet ports are aligned, said spool outlet and second chamber outlet ports are out of registry, and spool outlet means located coaxially downstream of said spool and connected through said secondary conduiting to said piston cylinder fluid motors.

16. The well rig as recited in claim 15 wherein each set of ports comprises three in number, equally circumferentially spaced apart whereby said spool member is rotated through a 40° arc in changing the direction of fluid flow from one outlet means to the other outlet means.

17. A well drilling and servicing rig comprising a closed circuit hydraulic fluid pressure lift system and lift line means directly operable therefrom, said closed circuit hydraulic fluid pressure lift system including prime mover means comprising a pair of prime movers with hydraulic fluid pump means for providing hydraulic fluid under pressure comprising a pair of pumps, one driven by each prime mover, at least a pair of reciprocable piston cylinder fluid motors, fluid pressure controlled dump valve means, control valve means, a hydraulic fluid supply tank and conduit means interconnecting the components of said fluid pressure lift system, said dump valve means comprising a pair of dump valves, each interposed in said conduit means, downstream of said pumps, said conduit means comprising primary conduiting connecting said supply tank through said pump means and said dump valve means, secondary conduiting connecting said dump valve means through said control valve means to said piston cylinder fluid motors, first relief conduiting connecting said control valve means to said supply tank and second relief conduiting connecting said dump valve means to said supply tank, said dump valve means including fluid pressure regulated valve means for relieving hydraulic fluid in said system through said second relief conduiting to said supply tank in response to pressure in said system exceeding a predetermined pressure, each of said reciprocable piston cylinder fluid motors including a stationary component and a reciprocating component, and means connecting said lift line means to said reciprocating components.

18. The well rig as recited in claim 17 further comprising a third hydraulic fluid pump driven directly from one of said prime movers.

19. The well rig as recited in claim 17 wherein each of said pumps comprises a rotary screw constant displacement hydraulic pump having high pressure, low volume characteristics for imparting heavy load lift capacity to said fluid pressure lift system and low pressure, high volume characteristics for imparting light load, high speed lift capacity to said fluid pressure lift system.

20. The well rig as recited in claim 19 further comprising a third rotary screw constant displacement pump driven directly from one of said prime movers.

21. The well rig as recited in claim 20 further comprising rotary table means driven by said third pump.

22. The well rig as recited in claim 20 further comprising rotary table means and power tong means driven by said third pump.

23. The well rig as recited in claim 17 further comprising cooling means interposed in said first relief conduiting and said second relief conduiting for cooling said hydraulic fluid before return thereof to said supply tank.

24. The well rig as recited in claim 17 further comprising a hydraulic motor, driven by one of said pumps, and a sand reel, driven by said hydraulic motor.

25. The well rig as recited in claim 17 wherein the inlet port of one of said dump valves is connected to the outlet port of the other of said dump valves and to the outlet port of one of said pumps.

26. The well rig as recited in claim 17 wherein said control valve means comprise a two port, rotary valve, one of said ports being connected to said secondary conduiting, the other of said ports being connected to said first relief conduiting whereby when said rotary valve is closed, said hydraulic fluid is directed to said piston cylinder fluid motors and when said rotary valve is open, said hydraulic fluid is directed to said first relief conduiting and said supply tank.

27. The well rig as recited in claim 17 wherein each of said dump valves comprises a valve body having an inlet port connected to said primary conduiting, and an outlet port connected to said secondary conduiting, said fluid pressure regulated valve means comprising a dumping port connected to said second relief conduiting, a dumping valve interposed within said dumping port and normally closing said dumping port, a control rod mounted on said dumping valve, and fluid pressure operated control means operatively connected to said control rod for maintaining said dumping valve normally closed, whereby in response to pressure of hydraulic fluid within said valve body exceeding the amount of fluid pressure in said fluid pressure control means needed to maintain said dumping valve in its normally closed condition, said dumping valve opens to relieve excess hydraulic fluid through said second relief conduiting to said supply tank.

28. The well rig as recited in claim 17 wherein said fluid pressure operated control means comprise a pilot valve assembly mounted on said valve body of said dump valve, opposite said dumping valve, a first piston mounted on an end of said control rod opposite said dumping valve, said control rod being located internally of said valve body, a second piston mounted on and spaced above said first piston, externally of said valve body, means defining a closed chamber about, beneath and above said second piston, said first piston sealing said valve body from said chamber, said chamber beneath said second piston being connected to a source of fluid under a predetermined pressure to maintain said dumping valve normally closed, and said chamber above said second piston being connected to a source of fluid under pressure for selective opening of said dump valve, whereby said dump valve further functions as a control valve.

29. The well rig as recited in claim 28 wherein said control means fluid under a predetermined pressure is a gas and wherein the internal head area of said dumping valve is less than the internal head area of said second piston whereby said predetermined pressure of said gas required to maintain said dumping valve normally closed is less than the pressure of said hydraulic fluid.

30. The well rig as recited in claim 17 wherein said valve body outlet port further comprises check valve means mounted therein for preventing backflow of fluid through said outlet port.

* * * * *